US012460545B2

(12) United States Patent
Gimpel et al.

(10) Patent No.: US 12,460,545 B2
(45) Date of Patent: Nov. 4, 2025

(54) CUTTING APPARATUS

(71) Applicant: SANDVIK MINING AND CONSTRUCTION G.M.B.H., Zeltweg (AT)

(72) Inventors: Martin Gimpel, Leoben (AT); Hubert Kargl, Gaal (AT); Bernhard Ebner, Knittelfeld (AT); Guenther Staber, Murau (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 47 days.

(21) Appl. No.: 17/630,572

(22) PCT Filed: Jul. 31, 2019

(86) PCT No.: PCT/EP2019/070578
§ 371 (c)(1),
(2) Date: Jan. 27, 2022

(87) PCT Pub. No.: WO2021/018390
PCT Pub. Date: Feb. 4, 2021

(65) Prior Publication Data
US 2022/0259973 A1 Aug. 18, 2022

(51) Int. Cl.
*E21D 9/10* (2006.01)

(52) U.S. Cl.
CPC ..... *E21D 9/1013* (2013.01); *E21D 9/102* (2013.01); *E21D 9/104* (2013.01); *E21D 9/1093* (2013.01)

(58) Field of Classification Search
CPC ..... E21C 27/10; E21C 27/14; E21C 27/16; E21C 27/22; E21C 27/24; E21D 9/1006; E21D 9/1013; E21D 9/102; E21D 9/1026; E21D 9/1033; E21D 9/104; E21D 9/1046; E21D 9/1093
See application file for complete search history.

(56) References Cited

U.S. PATENT DOCUMENTS 14,483 A * 3/1856 Wilson ..... E21D 9/10 299/110
3,041,055 A * 6/1962 Risse ..... E21C 27/22 175/391

(Continued)

FOREIGN PATENT DOCUMENTS

CN 109511270 A 3/2019
DE 2458295 A1 * 6/1976

(Continued)

*Primary Examiner* — Janine M Kreck
(74) *Attorney, Agent, or Firm* — Corinne R. Gorski

(57) ABSTRACT

A cutter head for excavating hard rock materials in rock face includes a carrier attachable to a cutter arm of a cutter machine and a drive shaft rotatably supported by the carrier. The drive shaft is rotatable about a drive axis and has at one end a support portion for mounting disc cutters. A plurality of disc cutters are mounted on the support portion and configured to perform undercutting against the rock face. Each disc cutter is rotatable about a respective support axis, the respective rotational axis of each disc cutter being configured to be substantially transverse to the rotational axis of the cutter head. A mining machine including the cutter head is also disclosed.

17 Claims, 6 Drawing Sheets

(56) References Cited

U.S. PATENT DOCUMENTS

| | | | | | |
|---|---|---|---|---|---|
| 3,493,165 | A * | 2/1970 | Schonfeld | E21D 9/113 | 299/56 |
| 3,995,907 | A * | 12/1976 | Dubois | E21D 9/1093 | 180/8.5 |
| 4,548,442 | A * | 10/1985 | Sugden | E21D 9/12 | 299/33 |
| 2010/0001574 | A1* | 1/2010 | Bechem | E21C 27/22 | 299/10 |
| 2014/0091612 | A1* | 4/2014 | Rowher | E21C 27/24 | 299/10 |
| 2014/0251696 | A1 | 9/2014 | Cox | | |
| 2015/0204190 | A1* | 7/2015 | Krings | E21D 9/1026 | 299/10 |
| 2017/0306758 | A1* | 10/2017 | Ebner | E21D 9/1033 | |
| 2018/0363462 | A1* | 12/2018 | Raschka | E21D 9/1026 | |

FOREIGN PATENT DOCUMENTS

| | | | | |
|---|---|---|---|---|
| EP | 0979926 | A2 * | 2/2000 | |
| JP | 2001003688 | A | 1/2001 | |
| SU | 618059 | A3 | 7/1978 | |
| SU | 917705 | A3 | 3/1982 | |
| WO | 0046486 | A1 | 8/2000 | |
| WO | 0201045 | A1 | 1/2002 | |
| WO | 02066793 | A | 8/2002 | |
| WO | 03001031 | A1 | 1/2003 | |
| WO | 2010050872 | A1 | 5/2010 | |
| WO | 2014026761 | A2 | 2/2014 | |
| WO | 2016055087 | A1 | 4/2016 | |
| WO | WO-2016055383 | A1 * | 4/2016 | C01B 33/035 |

* cited by examiner

CUTTING APPARATUS

RELATED APPLICATION DATA

This application is a § 371 National Stage Application of PCT International Application No. PCT/EP2019/070578 filed Jul. 31, 2019.

FIELD OF INVENTION

The present invention relates to a cutter head and a mining machine suitable for creating tunnels or subterranean roadways and in particular, although not exclusively, to an undercutting apparatus that is capable of cutting hard rock material.

BACKGROUND ART

A variety of different types of excavation machines have been developed for cutting drifts, tunnels, subterranean roadways and the like in which a rotatable head is mounted on an arm so as to create a desired tunnel cross sectional profile. To cut a lower profile tunnel with lower tunnel height that may be comparable to a diameter of a cutter head, the creation of the tunnel can be made by horizontal swinging operation of a cutter head, each time only a single layer is cut by pivoting movement of the cutter head in the lateral sideways direction. In order to be adapted for cutting hard rock, disc-like or roller-like form of cutters are considered in existing design for achieving undercut effect, the disc cutters are deposited on the cutter head such that the rotational axes of disc cutters are substantially parallel to the rotational axes of the cutter head.

ZA200206394 describes an extraction machine for extracting hard rocks, in which disc or roller tools operating according to the undercut principle are provided with, wherein the disc or roller tools are mounted for rotation on a swivelling jib arm of the machine, with a head carrying the tools, the axis of rotation of which extends essentially in the direction of the jib arm axis, wherein the head carrying the tools on the machine frame is mounted for swivelling around a vertical axis. WO0201045 describes a similar mining machine to the above described machine However, in the above described machine it is observed that a peak force is present on the individual cutting tools at initial phase of contacting rock (when disc or roller tools strike on rock face) and at end phase of leaving rock (when disc or roller tools leave the rock face), in particular there presents a peak value of reaction force from the rock, including normal force and lateral force, here a mean value of the reaction force in statistic sense is referred to. Such a peak force tends to result in extra wear to disc or roller tools. Therefore, conventional cutting machines are not optimised to cut hard rock whilst creating a tunnel or subterranean cavity efficiently with reduced wear and production costs. Accordingly, what is required is a cutting machine that addresses these problems.

SUMMARY OF THE INVENTION

It is an objective of the present invention to provide a cutter head and a mining machine suitable for cutting hard rock having a strength typically beyond 120 MPa in undercutting mode, particularly for achieving a tunnel with lower profile. It is a further specific objective to provide a cutter head with its cutting tools suffering from less wear during cutting operation. It is a further specific objective to provide a mining machine that, when advancing forward and in operation, creates a cut path with varying cut spacing.

It is an intention to overcome the negative effect of a conventional mining machine, in which the rotational axis of a disc cutter is substantially aligned with the rotational axis of the cutter head carrying the disc cutters thereon, during advancement of the cutter head, the individual disc cutters tend to have substantially equal cut spacing; further, when a disc cutter strikes into the rock and gets out of contact with the rock, the penetration approaches a minimal value of zero; the cutter head in this conventional configuration suffers a peak value of reaction force occurring at the initial phase of contacting rock also at the end phase of leaving rock. In undercutting model, such peak forces contribute less to the cutting performance, and more to causing significant wear to the disc cutter.

To overcome this above-mentioned negative effect, the group of disc cutters or disc-like roller cutters are arranged on the support portion in a manner that the respective rotational axis of each disc cutter is configured to be substantially transverse to the rotational axis of the cutter head, an individual disc cutter creates a groove or channel into the rock face as the head is driven about its rotational axis. The head may then be pivoted laterally so as to overcome the relatively low tensile strength of the overhanging rock to provide breakage via force and energy that is appreciably lower than a more common compressive cutting action provided by cutting picks and the like. Advantageously, the individual disc cutter has a characteristically varying cut spacing over a single rotation of the cutter head, and no peak value of reaction force is present at the initial phase of contacting rock and at the end phase of leaving rock.

In order to achieve high cutting efficiency and to cope with the strength of hard rock (which requires a significantly large lateral force being applied to the rock face), it is generally required that each individual disc cutter comprises a single layer of an annular cutting edge—for example a cutting ring, or a single layer of an annular cutting arrangement defined by the outermost cutting tips of a plurality of cutting elements (such as cutting buttons) arranged on the outer periphery of the disc cutter. This corresponds to single-layer cutting mode, at each time of lateral slewing movement of the cutter arm, the cutter head removes one layer of rock. In this mode, multiple layers of rock are sequentially fractured one after another, where each layer is free of confinement at the free face of rock (since a neighbouring layer is already cracked by the previous cutting cycle), individual layers can be broken much easier, thus less energy is consumed, consequently the required overall cutting power decreases. On the contrary, in multiple-layer cutting mode, multiple layers of rock are cracked simultaneously in the same cutting cycle, an inner layer of rock is confined by the outer layer rock and is not easily cracked. An example for multiple-layer cutting mode is a conventional milling roller that includes multiple layers of cutting chisels or bit-like tools being arranged spirally over the carrier circumference or being distributed centrically about a rotational axis, for example being placed on a surface of a cylindrical or tapered or conical shaped cutter tool. Such a milling roller is not suitable or not practical for excavating hard rock in undercutting mode.

According to a first aspect of the present invention there is provided a cutter head for excavating hard rock materials in rock face, which comprises: a carrier that is attachable to a cutter arm of a cutter machine, and a drive shaft rotatably supported by the carrier, the drive shaft being rotatable about a drive axis and comprising at one end a support portion for mounting disc cutters; a plurality of disc cutters mounted on the support portion and configured to perform undercutting against the rock face; wherein each disc cutter is rotatable about a respective support axis, the disc cutters are attached on the support portion substantially in a manner that the support axes of the disc cutters extend to intersect with one another at the drive axis at an intersection point and lie within a common conical surface. In other words, the support axes extend substantially radially with respect to the intersection point, and form a cone-like shape. The disc cutters are attached on the support portion in a manner that the support axes of the disc cutters extend to essentially intersect with one another at the drive axis at an intersection point and essentially lie within a common conical surface.

The disc cutters have annular cutting edges, upon rotation of the cutter head, individual disc cutters may alternatively get contact with the rock face, and after a period of time leave the rock face sequentially, about half of the disc cutters are not in contact with the rock at each time instance. When a disc cutter strikes into the rock, the cut has a cut spacing of zero, as the cut continues, the cut spacing gradually increases to a maximum defined by the previous advance distance (sump) of the mining machine. After reaching the maximum the cut spacing decreases to zero until the tool gets out of contact with the rock. During the cutting, the penetration of the disc cutter is however maintained more or less constant at maximal value.

The main beneficial effects include significantly reduced forces on the disc cutter due to the gradual changing of the cut spacing and and significantly reduced confinement to the disc cutter at the beginning and ending stages of the individual cuts. The reduced forces include reduced normal force perpendicular to the advancing direction of the tool and reduced lateral force parallel to the advancing direction of the tool, and advantageously result in less wear and longer tool lifetime, less frequently replacement of disc cutters indicates reduced extra machine down time. Consequently, not only the expense of wear parts is heavily reduced, but also the productivity of the machine is increased. Another benefit is the improved rock wall quality due to the gradually increasing cut spacing, especially on the floor, roof and face.

By the wording "substantially" it is meant to include the situations with a certain extent of deviation. For instance, one support axis may be slightly offset (for example by an offset of ±15 mm) from a common conical surface defined by the other support axes, and/or do not strictly pass through a common vertex of the other support axes. Similarly, considering angular deviation, it refers to an angle offset in a range between about 0 degree and about ±20 degrees, preferably in a range between about ±1 degree and about ±15 degrees, the support axes of the disc cutters being substantially transverse to the rotational axis of the cutter head, may include (or encompass) a perpendicular alignment.

The disc cutters represent all cutter tools placed on the cutter head, no other disc cutters placed in other orientation are included. The disc cutters are positioned at a same side of the carrier. They may be generally annular or disc shaped roller cutters and comprise a sharp annular cutting edge configured specifically for undercutting hard rock. In one implementation, each disc cutter may include a cutter ring or cutter disc in rigid connection to a cutter hub that is rotatably mounted at a disc shaft, each disc shaft is in rigid connection to the support portion (such as a cutter wheel). In another implementation, the cutter hub may be fixedly attached to the support portion, and the cutter disc is fixed to the disc shaft rotatable relative to the cutter hub.

Preferably, the disc cutters are spaced apart from the intersection point by the same offset.

Preferably, the disc cutters are of the same configuration in structure, preferably the disc cutters are uniformly distributed about a circumference in a plane perpendicular to the drive axis. Seen from the intersection point, the disc cutters are uniformly distributed in respective radial direction.

Preferably, the cutter head further comprises a flywheel coupled to the drive shaft, for example coupled indirectly via a gear mechanism to the drive shaft, the flywheel is configured for storing rotational energy, and helps to resist rapid changes in rotational speed by their moment of inertia.

Optionally, each disc cutter comprises a single layer of annular cutting edge, or a single layer of annular cutting arrangement defined by the cutting tips of a plurality of cutting elements arranged on the outer periphery of the disc cutter. Preferably, the cutting elements are in the form of cutting buttons consecutively distributed on the outer periphery of the disc cutter without interruption.

Optionally, the support axis of each disc cutter extends inclined relative to the drive axis by a disc inclination angle, preferably the disc inclination angle is in a range between 45 to 89 degrees, more preferably in a range from 60 to 80 degrees. The disc inclination angle may be set depending on the diameter of the disc cutters and the separation between an outermost cutting edge of the disc cutter and the drive axis.

Optionally, each disc cutter is independently rotatable about the respective support axis via a bearing.

Preferably, the cutter head further comprises a motor supported on the carrier, configured to actuate the drive shaft to rotate about the drive axis via a gear mechanism, preferably the gear mechanism comprises a first stage planetary gear coupled in series to a second stage planetary gear.

Preferably, the cutter head further comprises a plurality of material cleaning parts deposited between neighbouring disc cutters, and configured to clean material from the rock face.

Optionally, the gap between two neighbouring disc cutters is minimised so that the cutter head comprises as many disc cutters as possible, preferably the disc cutters has a diameter of 13 inches.

According to a further aspect of the present invention there is provided a cutter apparatus for creating a tunnel, comprising a main frame; a support mounted on the main frame and slidable relative to the main frame in the longitudinal direction of the cutter apparatus; a cutter arm mounted on the support and rotatable about a vertical axis; a cutter head according to any of above described embodiments and mounted at a distal end of the cutter arm.

Preferably, the cutter head is coupled to the cutter arm in a way such that a required angular offset of outermost cutting edge is satisfied, the angular offset of outermost cutting edge is defined by two rays starting from a rotation centre at the vertical axis, with one ray towards the outermost cutting edge, and the other ray perpendicular to the drive axis of the cutter head.

Preferably, the rotational axis of the cutter head extends substantially transverse to the longitudinal axis of the cutter arm which crosses the vertical axis.

Preferably, the cutter head is mounted at a distal end of the cutter arm in a manner that a free-cutting angle is between 30 to 40 degrees, preferably 35 degree. It is observed that the incident angle of a disc cutter has key influence on the cutting efficiency and/or the reacting force on the disc cutter, all disc cutters shall be configured to follow the same effective incident angle. It is important to maintain a free-cutting angle (or called a contacting angle) of a disc cutter at an optimal value, the free-cutting angle is defined by the tangent line of the rock face at a contacting point to the rock and a plane defined by the annular cutting edge of the disc cutter, the free-cutting angle is dependent on the disc inclination angle and the angular offset of the outermost cutting edge, and falls within the range of 5 to 40 degrees, preferably, the free-cutting angle is in a range of 20 to 35 degrees.

The rotation speed of cutter head and the slewing speed of the cutter arm shall be controlled so that a required penetration is met and the machine achieves high productivity.

The slewing speed of the cutter arm is dependent on the rotation speed of cutter head, the amount of disc cutters, and required penetration.

Preferably, the cutter apparatus further comprises a loading means mounted on a lateral side of the cutter head, and configured to collect material that is cut off by the cutter head.

Optionally the cutter apparatus further comprises a slewing gear mechanism or a linear arm actuator to actuate the cutter arm to slew about the vertical axis, and/or a support actuator to actuate the support to slide relative to the main frame.

Optionally the cutter apparatus further comprises a plurality of floor and roof engaging means mounted at the main frame and/or at the support, extendible and retractable to raise and lower the cutter apparatus.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1A:
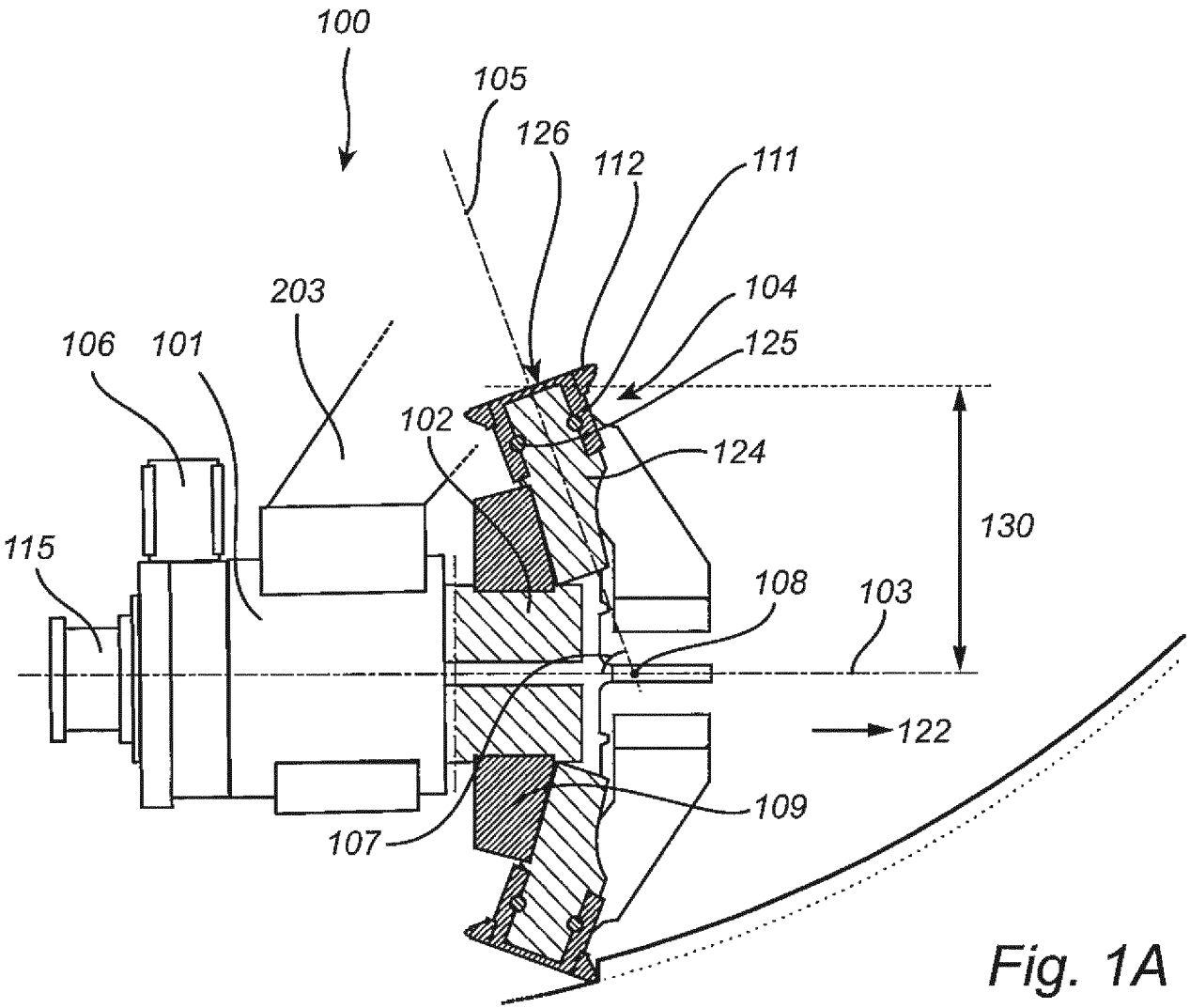
FIG. 1A is a top view of a cutter head according to a specific implementation of the present invention, with the front part in sectional view.
Figure 1B:
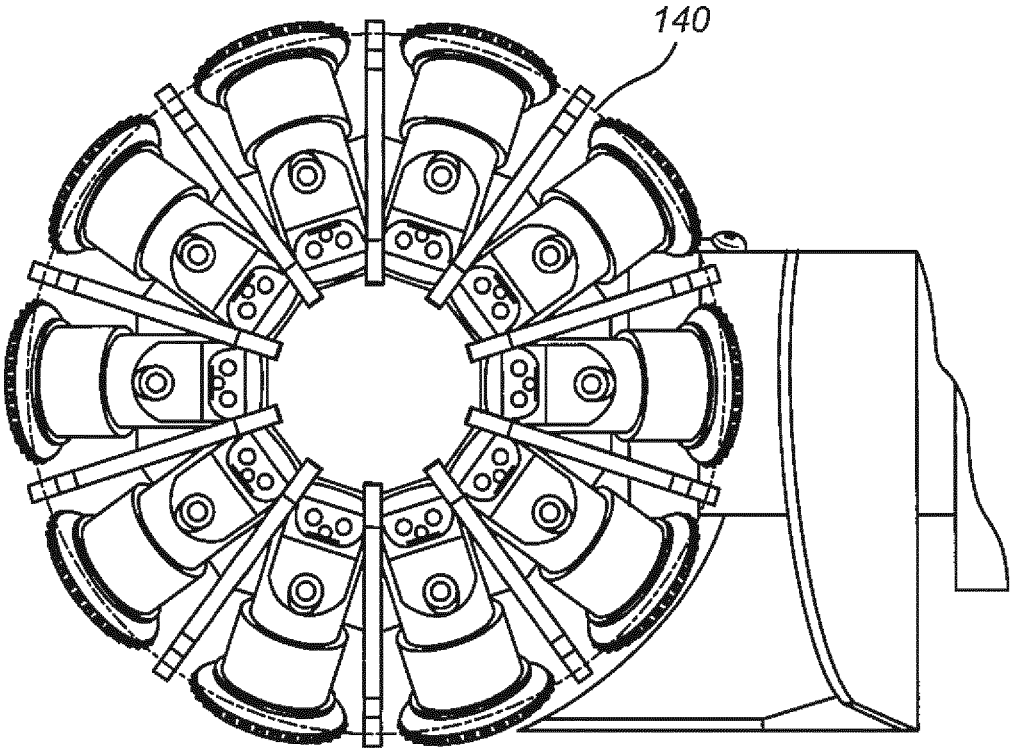
FIG. 1B is a front view of the cutter head of FIG. 1.
Figure 1C:
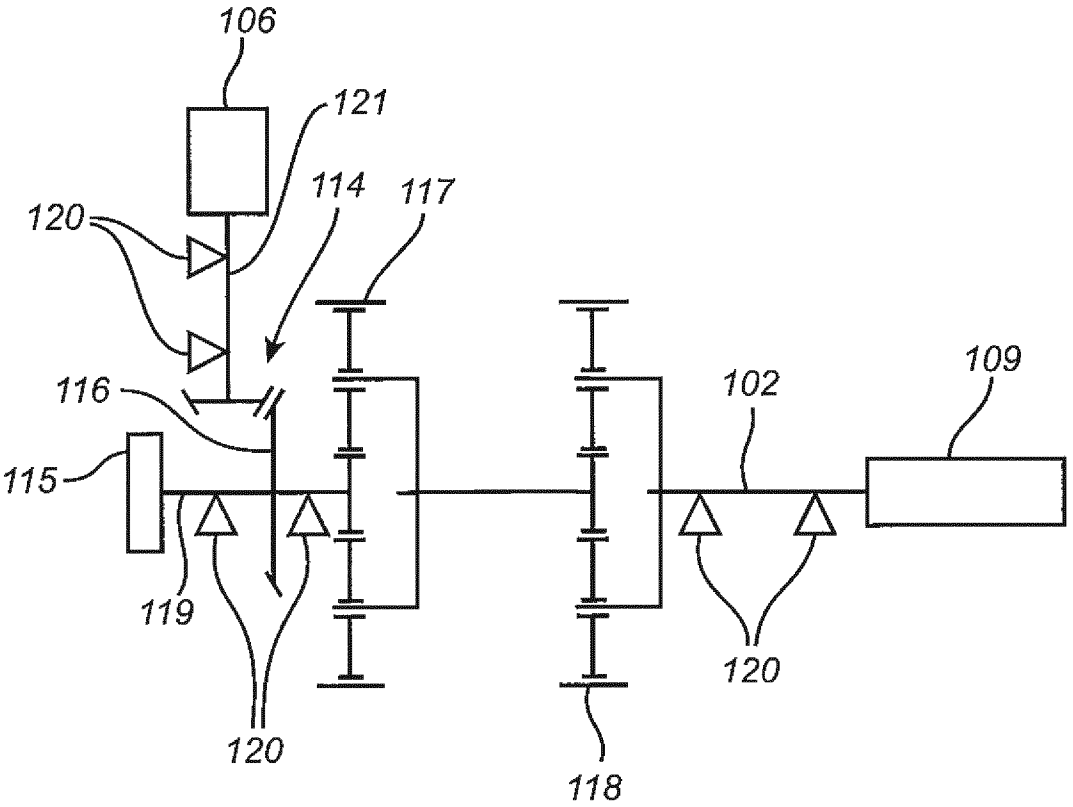
FIG. 1C is a schematic representation of a speed reduction mechanism of cutter head of FIG. 1.

FIG. 1A illustrates a cutter head 100 with the front part in sectional view, the front side of which is indicated by arrow 122, the cutter head 100 comprises a cylindrical shaped or drum-like body that may be fastened to a suitable holding arm or boom 203, the body includes a housing or stationary holder 101 which may be tubular form having a chamber as a receptacle for shaft and gear, and a drive shaft 102 that is journaled to the housing 101 freely rotatably by means of bearings 120 such as tapered roller bearings arranged in an O arrangement or X arrangement, an electronic or hydraulic motor 106 can be mounted on the body for actuating the drive shaft 102 to rotate about a drive axis 103 via a speed reduction mechanism, motor 106 is connected to motor shaft 121 that is supported via bearings 120 on housing 101. As shown in FIG. 1C, the speed reduction mechanism includes a bevel gear stage 114 in engagement with a first stage planetary gear 117 which is in series coupled to a second stage planetary gear 118, the carrier of the first stage planetary gear introduces rotation to the sun gear of the second stage planetary gear 118, a bevel gearwheel 116 may be shrink-fit connected to a gear shaft 119, gear shaft 119 is supported via bearings 120 on housing 101, at rear side the gear shaft 119 it is coupled to a flywheel 115, the front side of the gear shaft 119 acts as input to the sun gear of the first stage planetary gear 117. The rotation of bevel gear stage 114 is introduced by motor 106 and consequently transferred to shaft 119, finally the carrier of the second stage planetary gear introduces rotation to the drive shaft 102. The gear ratio for the bevel gear stage 114, the first stage planetary gear 117 and the second stage planetary gear 118 may be set depending on the properties of motor 106 and a target rotational speed of the cutter head, and may be chosen such that the speed of the drive shaft 102 is in the range of 20-60 rpm.

Turn back to FIG. 1A, the drive shaft 102 projects out of a front end of the housing 101 and includes therein a cutter wheel 109 for mounting a group of disc cutters 104, the cutter wheel 109 and the drive shaft 102 are connected fixedly in terms of rotation to one another or integrally formed in one piece. The group of disc cutters 104 are of the same kind of disk roller cutters and have the same design details, i.e. the same in dimension, in structure and in drive mechanism, in other words, they are structurally and functionally identical to each other. The arrangement of all disc cutters 104 disclosed herein may have a symmetrical or substantial symmetrical configuration with respect to the drive axis 103. Referring to FIG. 1B the disc cutter 104 are mounted in a generally radial direction on the cutter wheel 109 facing outward, uniformly spaced apart from each other on a same outer circumference 140.

Each disc cutter 104 is freely rotatable about a support axis 105, the support axis 105 may intersect with one another at the drive axis 103 at intersection point 108. The support axis 105 of each disc cutter runs inclined relative to the drive axis 103 by a disc inclination angle 107 which shall be substantially the same value for all disc cutters. Thus the respective support axes 105 define a conical surface with apex at the intersection point 108. The disc inclination angle 107 is dependent on the diameter of the disc cutters and the separation 130 between a centre of cutter ring 112 and the drive axis 103, preferably the disc inclination angle 107 is in a range between 60 to 80 degrees, more preferably the angle 107 is 70 degrees.

Further, the disc cutters 104 are spaced apart from the drum axis 103 by the same offset 130 in radial direction and positioned in the same altitude along the direction of drive axis 103.

Each disc cutter may include a cutter disc or cutter ring 112 that is rigidly connected on one side to a cutter hub 111 that is in turn rotatably mounted at a disc shaft 124, bearings 125 permit the cutter hub to be freely rotatable around the disc shaft 124, a radially outer portion of each disc 112 by rotation of the disc configured to abrade rock and create a cut groove therein, each disc shaft 124 is of cylindrical shape and in rigid connection to the cutter wheel 109 e.g. via fastening screws.

Figure 3:
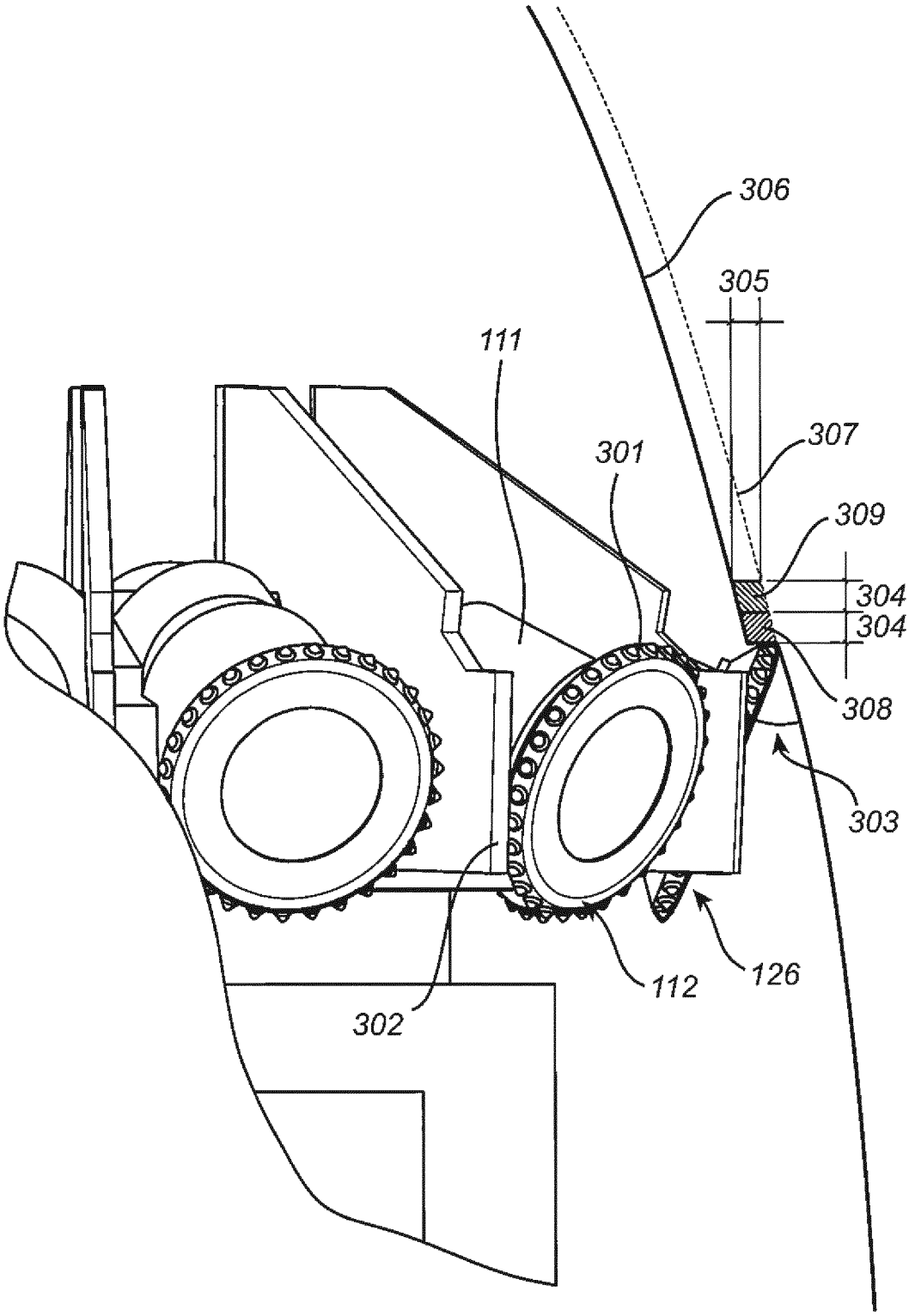
FIG. 3 is a magnified top perspective view of a part of a cutter head according to a specific implementation of the present invention.

Design details of a disc cutter 104 is partly shown in FIG. 3, annular cutter ring 112 is mounted on the cutter hub 111 via shrink-fit or form-fit or screw bolt connection. A plurality of cutter buttons 301 made of diamond or carbide or other hard material are consecutively and uniformly embedded along the outer periphery of the cutter ring, the buttons are oriented to face obliquely outwards with the tips forming a general annular cutter edge. A radial outer face with respect to the support axis 105 is indicated by reference symbol 126, the outer face is spaced apart from the intersection point 108 by an offset which is the same value for all disc cutters 104.

The cutter head 100 further includes a set of shovels 302 mounted fixedly in terms of rotation to the cutter wheel 109, each shovel extends in a respective plane across the drive axis 103, and is positioned between a pair of neighbouring disc cutter 104, by means of the shovel, released material can be loaded into a conveyor (not shown). For example the shovel can be a planar board suitable for scraping off rock deposits left on rock face.

FIGS. 1A to 1C are for illustrating purpose, in another embodiment, depending on the amount of disc cutters 104, support axis 105 of a disc cutter and that of an opposite disc cutter may not necessarily be in the same plane.

Figure 2:
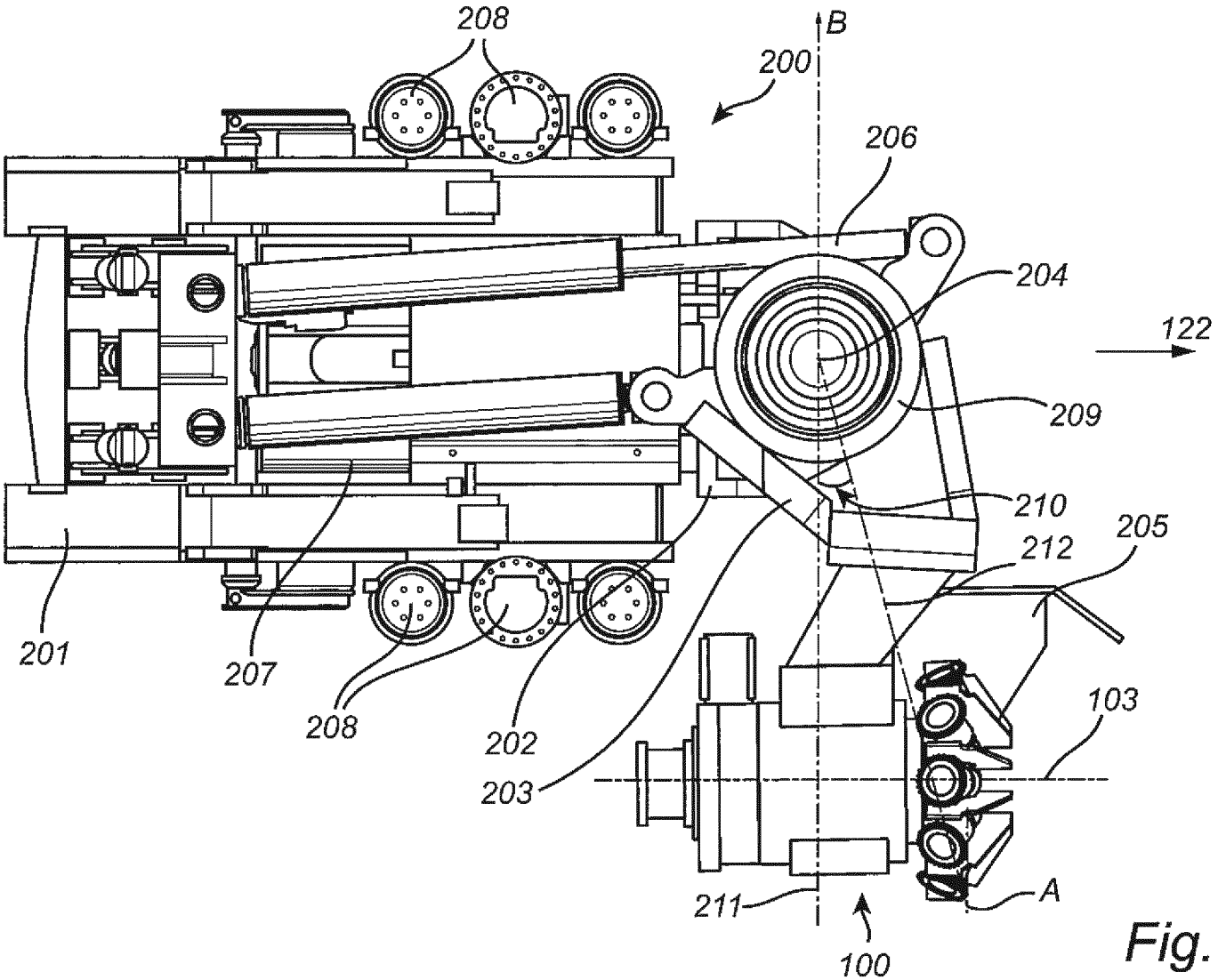
FIG. 2 is a plan view of a cutter apparatus according to a specific implementation of the present invention.

FIG. 2 illustrates one embodiment of a mining machine 200 for excavating hard rock, the machine comprises a main frame (chassis) 201, which is coupled to a pair of crawlers (or track wheels), the crawlers are driven via track gear to move the main frame within a tunnel, a support 202 is movably coupled to the main frame 201 and is actuated by linear drive 207 such as a hydraulic actuator to slide on the main frame 201 via a guide (not shown), and a loading means 205 mounted on a lateral side of the cutter head, and configured to collect material that is cut off by the cutter head. The support 202 carries a pivoting mechanism 209 that is rotatable about a vertical axis 204, the pivoting mechanism 209 in turn mounts an arm structure 203 which can be cranked or bent, the arm structure 203 at its distal end carries a cutter head 100, optionally via a holder, a pair of actuators 206 such as hydraulic cylinders are coupled to the support 202 to rotate the pivoting mechanism 209 in horizontal plane, such that the cutter head 100 can be slew about an angle in range 0 to 180 degrees from initial position indicated as A (where the drive axis 103 runs substantially parallel to the longitudinal direction of the machine), to a position B.

The machine frame can be braced between the tunnel roof and floor by a plurality of jacking legs 208, wherein the jacking legs are arranged on both sides of the longitudinal centre plane of the machine frame.

From FIG. 2 it is seen that, when the drive axis 103 of the cutter head is parallel to the longitudinal direction of the machine, the enveloping of the disc cutters is located in the front 122 relative to the rotational centre 204, i.e. an angular offset 210 of outermost cutting edge of disc cutter is present, the angular offset 210 is defined by two rays starting from a rotation centre at the vertical axis 204, with one ray 212 towards outermost cutting edge, and the other ray 211 perpendicular to the drive axis 103 of the cutter head. The angular offset 210 may be set in the range of 0 to 25 degrees.

It is important to maintain a free-cutting angle (or called a contacting angle) of a disc cutter at an optimal value, FIG. 3 illustrates a cutter head in cutting operation, the free-cutting angle 303 is defined by the tangent line of the rock face at contacting point to rock and a plane of outer face 126, the plane of outer face 126 is formed by the annular cutting edge of the disc cutter. The free-cutting angle is preferably kept as a small value, it may be set in the range of 5 to 40 degrees, preferably, the free-cutting angle is in the range of 20 to 35 degrees.

During operation of a cutter head 100, an individual disc cutter 104 is subjected to two rotational movements about two different rotational axes, i.e. in a first rotational movements about the drive axis 103, and in a second rotation about support axis 105. In addition, the disc cutter 104 is subjected to a pivoting movements about vertical axis 204. The disc cutter 104 pierces into mining material, thereby causing cracks in the mining material and eventually creates an undercut or slot. A previous cutting path is indicated by reference symbol 306, a succeeding path to be cut is indicated by reference symbol 307, all shown in a horizontal plane. A disk cutter first cuts in the base rock along cutting path 307 to remove a free section 308, a succeeding disk roller cutter comes to crush the base rock to remove a free section 309. A maximal penetration 304 or undercut depth into the mining material, which is in radial direction with respect to the support axis 105, may be set, for example, in a range between about 2 mm and about 20 mm for hard rock mining material. A cut spacing 305, which is in radial direction with respect to the drive axis 103, lies in a range of 0 to 150 mm preferably between 5 mm and 70 mm.

During cutting, the pivoting speed of the cutter arm is controlled in such a way that, the cutter ring of a succeeding disc cutter 104 comes into contact with the material to be removed at a point which is offset in a common horizontal plane from that of the cutter ring of the preceding disc cutter, wherein the offset corresponds to a required penetration 304.

Figure 4:
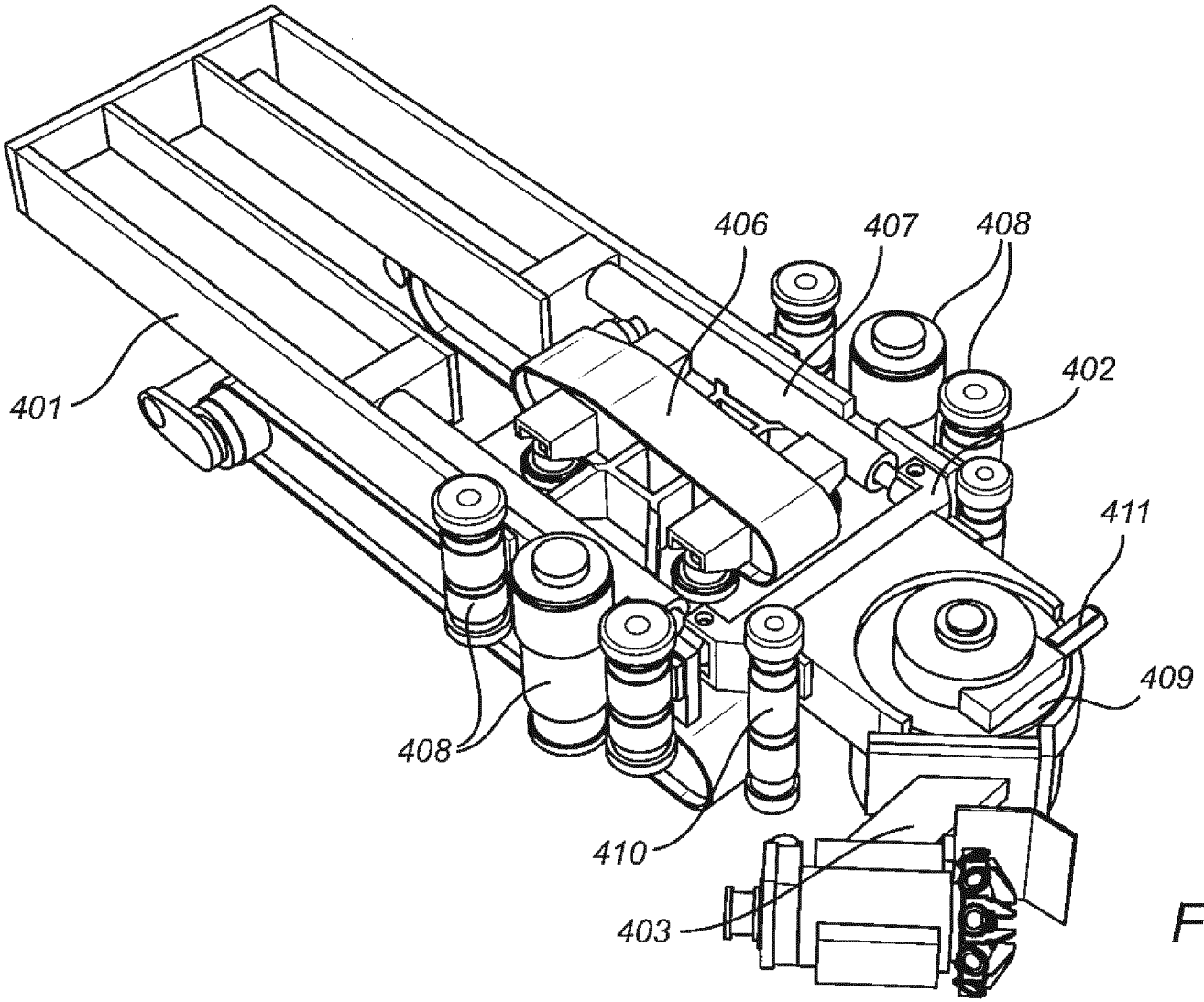
FIG. 4 is a front perspective view of a cutter apparatus according to another specific implementation of the present invention.

FIG. 4 illustrates another embodiment of a mining machine for excavating hard rock, the machine comprises a main frame 401, a support 402 movably coupled to the main frame 401 via a drawer structure e.g. a rod within a sleeve, and is actuated by an actuator 407 to slide on the main frame 401, a pivoting mechanism 409 carrying a cantilever arm 403 is mounted to the support 402, a cutter head 100 is mounted at the distal end of the cantilever arm. In this design, the longitudinal axis of cantilever arm 403 is substantially perpendicular to the drive axis of the cutter head.

The pivoting mechanism 409 includes a rotary drive or slew drive train inside, in order to achieve a specific reduction ratio, the drive train may comprise a first stage planetary drive coupled in series to a second stage planetary drive (not shown). A motor 411 is provided as resource to the drive train. Jacking legs 408 are connected the main frame. Additional jacking legs 410 may be provided to support the pivoting mechanism 409, optionally the additional jacking legs 410 may have rollers on foot. Other settings of the machine are similar to the machine of FIG. 2.

In operation, the machine 200 is set in the required position in the tunnel, depending on needs, operating parameters such as the slewing speed of the cutter arm, rotational speed of the cutter head etc. may be set. Jacking legs 208 are actuated to stabilize the machine within the tunnel; then cutter heads 100 is rotated via the motor 106, and cutter arm 203 is actuated to pivot about axis 204 to guide the cutter head to cut from position A to position B, thereafter cutter arm 203 is brought back to position A by pivoting of the arm in reverse direction. The support 202 together with the pivoting mechanism 209 is driven to slide forward by a distance corresponding to required sump depth, cutting is repeatedly performed from position A.

The sliding movement of support 202 and the succeeding cutting can be repeated many times until the maximal forward travel of the support 202 is achieved, then jacking legs 208 are retracted to engage the crawler 406 onto the ground. The machine 200 may then be advanced forward via crawler 406. Jacking legs are extended again for repeating the cutting cycle.

The slewing speed of the cutter arm is set dependent on the rotation speed of cutter head (amounts to 60 rev/min), the amount of disc cutters (8 to 12 pieces), and required penetration (2 to 20 mm).

The invention claimed is:

1. A cutter head arranged for excavating hard rock materials in rock face, the cutter head comprising:

a carrier attached to a cutter arm of a cutter machine, and a drive shaft rotatably supported by the carrier, the drive shaft being rotatable about a drive axis and including at one end a support portion for mounting disc cutters; and a plurality of disc cutters mounted on the support portion and configured to perform undercutting against the rock face, each disc cutter being undriven and freely rotatable about a respective support axis, wherein the disc cutters are attached on the support portion in a manner such that the support axes of the disc cutters extend to intersect with one another at the drive axis at an intersection point and lie within a common conical surface, and wherein the support axis of each disc cutter is inclined relative to the drive axis by a disc inclination angle, the disc inclination angle being in a range between 45 to 89 degrees.

2. The cutter head according to claim 1, wherein the plurality of disc cutters are spaced apart from the intersection point by a same offset.

3. The cutter head according to claim 1, wherein the plurality of disc cutters have a same configuration in structure, the plurality of disc cutters being uniformly distributed about a circumference in a plane perpendicular to the drive axis.

4. The cutter head according to claim 1, further comprising a flywheel coupled to the drive shaft.

5. The cutter head according to claim 1, wherein each disc cutter includes a single layer of an annular cutting edge, or a single layer of an annular cutting arrangement defined by cutting tips of a plurality of cutting elements arranged on an outer periphery of the disc cutter.

6. The cutter head according to claim 1, wherein the support axis of each disc cutter extends inclined relative to the drive axis by a disc inclination angle, the disc inclination angle being in a range between 60 to 80 degrees.

7. The cutter head according to claim 1, wherein each disc cutter is independently rotatable about the respective support axis via a bearing.

8. The cutter head according to claim 1, further comprising a motor supported on the carrier, the motor being configured to actuate the drive shaft to rotate about the drive axis via a gear mechanism, the gear mechanism including a first stage planetary gear coupled in series to a second stage planetary gear.

9. The cutter head according to claim 1, further comprising a plurality of material cleaning parts deposited between neighbouring disc cutters, the plurality of material cleaning parts being configured to clean material from the rock face.

10. The cutter head according claim 1, wherein a gap between two neighbouring disc cutters is minimised so that the cutter head includes a plurality of disc cutters, the plurality of disc cutters having a diameter of 13 inches.

11. The cutter head of claim 1, wherein an apex of the conical surface defined by the support axes is at the intersection point.

12. The cutter head of claim 1, wherein the support axes of the disc cutters are substantially transverse to the rotational axis of the cutter head.

13. A cutter apparatus arranged for creating a tunnel, the cutter apparatus comprising:

a main frame;

a support mounted on the main frame and slidable relative to the main frame in a longitudinal direction of the cutter apparatus; and a cutter head according to claim 1 mounted at a distal end of the cutter arm, the cutter arm being mounted on the support and rotatable about a vertical axis.

14. The cutter apparatus according to claim 13, wherein the cutter head is mounted at a distal end of the cutter arm in a manner that a free-cutting angle is defined by the rock face and a plane formed by a cutting edge of the disc cutter during cutting is in a range of 5 to 40 degrees.

15. The cutter apparatus according to claim 13 further comprising a loading means mounted on a side of the cutter head, the loading means being configured to collect material that is cut off by the cutter head.

16. The cutter apparatus according to claim 13, further comprising a slewing gear mechanism or a linear arm actuator arranged to actuate the cutter arm to slew about the vertical axis, and/or a support actuator to actuate the support to slide relative to the main frame.

17. The cutter apparatus according to claim 13, further comprising a plurality of floor and roof engaging means mounted at the main frame and/or at the support, the plurality of floor and roof engaging means being extendible and retractable to raise and lower the cutter apparatus.

* * * * *